US005520530A

United States Patent [19]

Siempelkamp

[11] Patent Number: 5,520,530

[45] Date of Patent: May 28, 1996

[54] CONTINUOUS BELT PRESS FOR MAKING PANELS

[75] Inventor: Dieter Siempelkamp, Krefeld, Germany

[73] Assignee: G. Siempelkamp GmbH & Co., Krefeld, Germany

[21] Appl. No.: 241,660

[22] Filed: May 12, 1994

[30] Foreign Application Priority Data

May 18, 1993 [DE] Germany ..... 43 16 555.9

[51] Int. Cl.[6] ..... B30B 5/06

[52] U.S. Cl. ..... 425/371; 100/151; 100/154

[58] Field of Search ..... 425/371; 100/93 R, 100/93 P, 151–154; 156/555, 583.5

[56] References Cited

U.S. PATENT DOCUMENTS

| | | | |
|---|---|---|---|
| 4,417,866 | 11/1983 | Sitzler | 425/364 R |
| 4,613,293 | 9/1986 | Gerhardt | 425/371 |
| 4,626,187 | 12/1986 | Kamada | 425/371 |
| 4,681,033 | 7/1987 | Crandall et al. | 100/151 |
| 5,042,372 | 8/1991 | Bielfeldt et al. | 425/371 |
| 5,044,269 | 9/1991 | Bielefeldt | 100/38 |
| 5,088,398 | 2/1992 | Bielfeldt | 425/371 |
| 5,112,209 | 5/1992 | Ahrweiler et al. | 425/371 |
| 5,224,367 | 7/1993 | Ahrweiler et al. | 425/371 |

FOREIGN PATENT DOCUMENTS

| | | |
|---|---|---|
| 2215618 | 10/1973 | Germany . |
| 2803522 | 1/1980 | Germany . |

*Primary Examiner*—James P. Mackey
*Attorney, Agent, or Firm*—Herbert Dubno; Andrew Wilford

[57] ABSTRACT

A continuous belt press has a frame having horizontally extending and vertically spaced upper and lower plates defining a horizontally extending gap having an upstream end and a downstream end and vertically spaced upper and lower upstream drums rotatable on the frame about respective horizontal drum rotation axes at the upstream end. Vertically spaced upper and lower downstream drums are rotatable on the frame about respective horizontal drum rotation axes at the downstream end and upper and lower endless steel belts are spanned over the respective upper and lower drums and each have a working stretch lying between the plates and a return stretch. Upper and lower sets of rollers are engaged between the working stretches and the respective plates. The drums are driven to advance the belts to move the working stretches horizontally in a transport direction to displace a workpiece in the direction through the gap. The downstream drums have a diameter which is greater than that allowable by the tension in the respective belts as they move around the downstream drums and the upstream drums have a diameter which is substantially less than the diameters of the respective downstream drums and that would not be usable on the downstream drums because it would exceed the permissible belt tension. Drives are provided for rotating the downstream drum with a predetermined torque and for rotating the upstream drum with a torque equal to between 0% and 75% of the predetermined torque of the downstream drums.

8 Claims, 1 Drawing Sheet

A
B
D
d
α
X
M
1
2
3
4
5
6
7
8a
8b
9
10
11
12
13
14
15
16
17
18

CONTINUOUS BELT PRESS FOR MAKING PANELS

FIELD OF THE INVENTION

The present invention relates to a belt press. More particularly this invention concerns a belt press used to make panels, for instance particle board, chip board, plywood, fiber board, or the like.

BACKGROUND OF THE INVENTION

A standard belt press has a frame having horizontally extending and vertically spaced upper and lower plates defining a horizontally extending gap having an upstream end and a downstream end, vertically spaced upper and lower upstream drums rotatable about respective horizontal axes at the upstream end, vertically spaced upper and lower downstream drums rotatable about respective horizontal axes at the downstream end, and upper and lower endless belts spanned over the respective upper and lower drums and each having a working stretch lying between the plates and a return stretch. Upper and lower sets of rollers engaged between the working stretches and the respective plates can be recirculated as the belts are advanced to move with the working stretches horizontally in a transport direction to displace a workpiece in the direction through the gap so that the working stretches are supported on the respective plates by these rollers.

In standard such systems as described in U.S. Pat. Nos. 4,417,866, 4,613,293, and 5,044,269 the drums are all of generally the same diameter. Both the upstream and downstream drums, furthermore, are driven with generally the same force so that the working stretches draw the workpiece along the gap. The effect is that the downstream drums, which are responsible for pulling the workpiece through the press, do twice as much work as the upstream drums. This system works well but requires an expensive drive and relatively large-diameter drums so that neither the upstream or downstream drums are subjected to excessive stress. In fact the tensions resulting from the drive action and the bending forces are combined in the drums.

OBJECTS OF THE INVENTION

It is therefore an object of the present invention to provide an improved continuous panel-making belt press.

Another object is the provision of such an improved continuous panel-making belt press which overcomes the abovegiven disadvantages, that is which has an improved drive system.

SUMMARY OF THE INVENTION

The instant invention is an improvement on a continuous belt press having a frame having horizontally extending and vertically spaced upper and lower plates defining a horizontally extending gap having an upstream end and a downstream end and vertically spaced upper and lower upstream drums rotatable on the frame about respective horizontal drum rotation axes at the upstream end. Vertically spaced upper and lower downstream drums are rotatable on the frame about respective horizontal drum rotation axes at the downstream end and upper and lower endless steel belts are spanned over the respective upper and lower drums and each have a working stretch lying between the plates and a return stretch. Upper and lower sets of rollers are engaged between the working stretches and the respective plates. The drums are driven to advance the belts to move the working stretches horizontally in a transport direction to displace a workpiece in the direction through the gap. According to the invention the downstream drums have a diameter which is greater than that allowable by the tension in the respective belts as they move around the downstream drums and the upstream drums have a diameter which is substantially less than the diameters of the respective downstream drums and that would not be usable on the downstream drums because it would exceed the permissible belt tension. The working stretches extend horizontally and a deflecting unit is provided engaging the return stretches to subdivide same into a horizontal downstream portion and an upstream portion extending at an angle to the horizontal so as to create allowable belt tensions at the upstream drums. Furthermore the downstream drums are provided with friction layers engaging the respective belts and drives are provided for rotating the downstream drums with a predetermined torque and for rotating the upstream drums with a torque equal to between 0% and 75% of the predetermined torque of the downstream drums.

Continuous belt presses of the above-described generally type are known (see for example German 2,215,618 filed 30 Mar. 1972 by K. Engels) having upstream drums that are smaller than the downstream drums. Here however the diameter of the upstream drums is selected so that it does not exceed the permissible tension in the belt. The downstream drums are of greater diameter than is necessary for the belt tension. The system of this invention, which controls the driving and provides a friction layer, has a substantially greater service life than such a prior-art system.

According to a feature of this invention means is provided for heating the platens and the upstream drums. The upstream drums directly engage the respective belts, that is with no intervening friction layer so there is direct metal-to-metal contact for best heat transfer. Furthermore according to the invention the belts have a width measured perpendicular to the transport direction which is generally equal to a width of the workpiece measured perpendicular to the transport direction. The diameters of the downstream drums are equal to $$D=d+B\cdot\tan\alpha$$

where

D=diameter of the downstream drums, d=diameter of the upstream drums,

B=length of the angled portion of the return stretch, and $\alpha$=angle between the upstream portion of the return stretch and the horizontal.

In accordance with a further feature of this invention means is provided connected to the deflector unit for adjusting the side-to-side position of the belts. The deflector unit can be an array of small-diameter rollers which is pivotal about an axis perpendicular to the plane of the belt. This type of system is described in German patent document 2,803,522 filed 21 Jan. 1978.

The belt according to this invention has a thickness between 1.5 mm and 2.5 mm, preferably about 2.3 mm. The friction layers are such that the belts do not slip on the downstream drums.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
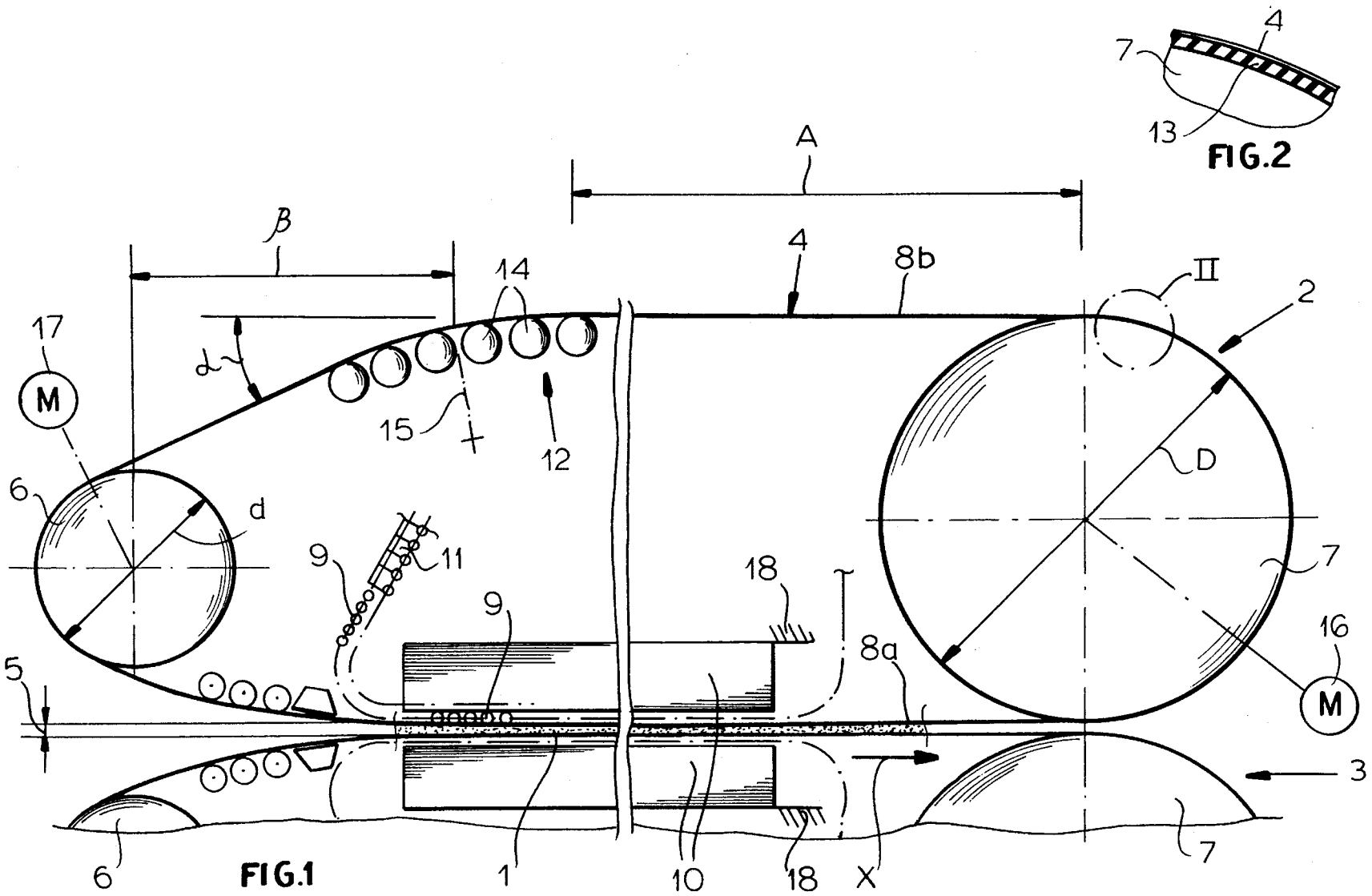
FIG. 1 is a largely schematic side view of the press according to the invention.
FIG. 2 is a large-scale view of the detail indicated at II in FIG. 1.

As seen in FIG. 1 a belt press for making a workpiece panel 1 that may be particle board, fiber board, plywood, chip board, or the like has substantially identical upper and lower press parts 2 and 3 mounted on a stationary frame shown schematically at 18 and together defining a press gap 5 through which the panel 1 moves in a horizontal transport direction X. Each press part 2 and 3 has an endless steel belt 4 spanned over a small-diameter upstream drum 6 and a large-diameter downstream drum 7 that subdivide the belts 4 into inner working stretches **8*a* that define the gap 5 and that move in the direction X and outer return stretches 8*b* that move oppositely. Each stretch 8*a* is supported by rollers 9 on a respective normally heated press plate 10. The rollers 9 are recirculated by a chain arrangement 11** that is standard in the art.

The drum 7 according to the invention has a diameter D which is substantially greater than a diameter d of the upstream drum 6. The diameter d is selected such that it could not be used on the downstream drum 7 because it would not produce sufficient surface contact to impart sufficient tension to the respective belt 4.

Each outer stretch **8*b* has a downstream substantially horizontal portion A and an upstream portion B inclined at an angle α to the horizontal. The transition is made over a curved array 12 of very small-diameter deflecting drums 14 that can pivot about an axis 15 transverse to the belt to allow some lateral adjustment of the belt 4** to prevent it from running off to the side.

The drum 7 is driven by a motor 16 and is provided as shown in FIG. 2 with an elastomeric high-friction layer 13 that substantially eliminates any possibility of slip between the drum 7 and the belt 4. The smaller upstream drum 6 has no such layer and can idle or be driven by a small-capacity drive 17 that is at least 25% weaker than the drive 16, and this drum 6 can be heated like the platens 10. The transverse width of the belts 4 is equal to or slightly more than the width of the workpieces 1 so that the belt edges do not get substantially cooler than the central parts of the belts 4.

In particular the drum diameters have the following relationship:

$$D=d+B\cdot\tan\alpha$$

The belts 4 have a thickness of between 1.5 mm and 2.5 mm, here 2.3 mm.

I claim:

1. In a continuous belt press having:

a frame having horizontally extending and vertically spaced upper and lower plates defining a horizontally extending gap having an upstream end and a downstream end;

vertically spaced upper and lower upstream drums rotatable on the frame about respective horizontal drum rotation axes at the upstream end;

vertically spaced upper and lower downstream drums rotatable on the frame about respective horizontal drum rotation axes at the downstream end;

upper and lower endless steel belts spanned over the respective upper and lower drums and each having a working stretch lying between the plates and a return stretch;

upper and lower sets of rollers engaged between the working stretches and the respective plates; and drive means connected to the drums for advancing the belts to move the working stretches horizontally in a transport direction to displace a workpiece in the direction through the gap;

the improvement wherein the upstream drums have a diameter which is substantially less than the diameters of the respective downstream drums;

the working stretches extend horizontally;

deflecting means is provided engaging the return stretches to subdivide same into a horizontal downstream portion and an upstream portion extending at an angle to the horizontal;

the downstream drums are provided with friction layers engaging the respective belts; and the drive means is provided with means for rotating the downstream drums with a predetermined torque and for rotating the upstream drums with a torque equal to between 0% and 75% of the predetermined torque of the downstream drums; and the diameters of the downstream drums are equal to $$D=d+B\cdot\tan\alpha$$

where:

D=diameter of the downstream drums, d=diameter of the upstream drums,

B=length of the angled portion of the return stretch, and

α=angle between the upstream portion of the return stretch and the horizontal.

2. The press defined in claim 1, further comprising means for heating the plates and the upstream drums, the upstream drums directly engaging the respective belts.

3. The press defined in claim 2 wherein the belts have a width measured perpendicular to the transport direction which is generally equal to a width of the workpiece measured perpendicular to the transport direction.

4. The press defined in claim 1, further comprising means connected to the deflecting means for adjusting the side-to-side position of the belts.

5. The press defined in claim 4 wherein the deflecting means is an array of small-diameter rollers.

6. The press defined in claim 1 wherein the belts have a thickness between 1.5 mm and 2.5 mm.

7. The press defined in claim 1 wherein the belts have a thickness of about 2.3 mm.

8. The press defined in claim 1 wherein the friction layers are such that the belts do not slip on the downstream drums.

* * * * *